US008845389B2

(12) United States Patent
Abrams

(10) Patent No.: US 8,845,389 B2
(45) Date of Patent: Sep. 30, 2014

(54) EXERCISE CLOTHING FOR USE DURING PREGNANCY

(76) Inventor: Sarah M. Abrams, Chicago, IL (US)

( * ) Notice: Subject to any disclaimer, the term of this patent is extended or adjusted under 35 U.S.C. 154(b) by 216 days.

(21) Appl. No.: 13/486,432

(22) Filed: Jun. 1, 2012

(65) Prior Publication Data

US 2012/0309265 A1 Dec. 6, 2012

Related U.S. Application Data

(60) Provisional application No. 61/492,909, filed on Jun. 3, 2011.

(51) Int. Cl.
*A41C 1/00* (2006.01)

(52) U.S. Cl.
CPC ..... *A41C 1/00* (2013.01)
USPC ..... 450/155; 450/151; 450/122; 450/124

(58) Field of Classification Search
USPC ..... 2/227, 228, 237, 236, 69; 450/155, 100, 450/101, 106, 107, 112, 114, 115, 122–125, 450/131, 132, 151
See application file for complete search history.

(56) References Cited

U.S. PATENT DOCUMENTS 2,897,823 A * 8/1959 Scheinberg ..... 450/118
2,955,598 A * 10/1960 Blatt ..... 450/122
3,080,869 A * 3/1963 Alberts ..... 450/118
4,746,318 A * 5/1988 Moyer ..... 450/155
5,097,537 A * 3/1992 Ewing ..... 2/409
5,136,727 A * 8/1992 Brisco ..... 2/409
5,729,836 A * 3/1998 Ewing ..... 2/409
5,983,404 A * 11/1999 Jackson ..... 2/406
6,728,973 B1 * 5/2004 Webley et al. ..... 2/400
7,143,453 B2 * 12/2006 Duran ..... 2/409
7,260,961 B1 * 8/2007 Kennedy et al. ..... 66/177
7,814,576 B2 * 10/2010 Nakazawa ..... 2/227
2009/0083894 A1 * 4/2009 Causey-Gabbe ..... 2/78.1

* cited by examiner

*Primary Examiner* — Gloria Hale
(74) *Attorney, Agent, or Firm* — Dennemeyer & Assoc. LLC

(57) ABSTRACT

In accordance with the present invention, a garment is provided having specific supportive panels for providing adequate back and belly support; in a preferred embodiment the garment is an exercise garment. The supportive panels of the garment are made of composites of expandable materials giving structural support to the garment such that the wearer's back is stabilized and the belly is supported to prevent drastic pitch, roll or yaw movements during exercise. The expandable materials are designed to yield such that excessive pressure against the belly is not caused as such pressure, found in garments of the prior art, can inflict pain to the musculature and skin surface of the wearer. The expandable materials provide support and allow for the natural growth of the body during pregnancy, providing a desirable combination of a supportive exercise garment that can be used throughout the gestation period.

3 Claims, 3 Drawing Sheets

EXERCISE CLOTHING FOR USE DURING PREGNANCY

CROSS-REFERENCE TO RELATED APPLICATIONS

This application is related to U.S. Provisional Patent Application No. 61/492,909, entitled Exercise Clothing for Use During Pregnancy, and is incorporated in full in this application as if set forth in its entirety herein.

FIELD OF THE INVENTION

The present invention concerns clothing for use during pregnancy. More particularly, the present invention concerns a garment that provides specific support to permit a pregnant woman to exercise vigorously during the pregnancy.

BACKGROUND

Pregnant women are encouraged to exercise throughout pregnancy to stay healthy, whether or not they were active before they became pregnant. However, as a result of the changes to a woman's body during pregnancy, exercise can become difficult and uncomfortable. Further, the particulars of the structure of the human belly, it distention and natural support, are anathema to the movements required to exercise. In addition, persons who are over-weight can find that their belly is distended in a way similar to that due to pregnancy and when such persons attempt to exercise they are often thwarted due to excessive movements of the belly; such can cause these people to abandon exercise to the detriment of their health.

While there are garments made with expandable belly portions, I have found that typically the belly portion consists of a panel of expandable material that stretches over the distended belly but provides no additional lumbar or back support and which has the tendency to have no control over the positioning of the waist band, particularly in the rear of the garment. It has been found that the waist band of such garments cause considerable discomfort to the wearer when it slips to a natural position at the waistline during use and or cuts into the flesh if too much elastic material is used. It would be preferable to have a waistline of a support and exercise garment that would remain at the more comfortable position well above the waistline, to provide support and comfort to the wearer both in stationary and active positions.

The statistics on exercise during pregnancy are extant. Experts say that nearly 80% of expectant mothers in the US buy clothing that is specifically maternity wear; the majority of these women have expressed frustration with the poor fit and style of the maternity items available to them. Approximately 4.1 million expectant mothers in the US every year; this figure is currently increasing as population figures continue to grow. Women are estimated to spend approximately $200 million annually on maternity clothing. Expectant mothers today seek to maintain their pre-pregnancy lifestyles, including working, socializing and exercising, but continue to lack sufficiently supportive and attractive clothing to do so. The maternity market grew 10% in the first decade of the 2000s, as women wanted to look as stylish and feel as comfortable as their pregnant celebrity counterparts.

Women account for more than 80% of athletic apparel purchasing. Athletic apparel is a growing market segment that currently comprises 13% of the total apparel market in the US; the athletic apparel market is expected to grow another 8.5% by 2014, to total $15.3 billion. 87% of athletic apparel purchasers wear the clothing for more than exercise activity; i.e. around the house, running errands, shopping, and school/work. Nearly all OB/GYNs recommend that women perform some type of exercise regularly throughout their pregnancies, regardless of each woman's athletic/workout history. Both the American Council of Obstetricians and Gynecologists and the Society of Obstetricians and Gynecologists of Canada recommend participation in aerobic and strength-conditioning activities for all women with uncomplicated pregnancies. Pregnant women are advised to exercise at least 30 minutes on most, if not all, days of the week in order to maintain a healthy lifestyle. Exercising during pregnancy has proved to help reduce discomfort, increase energy, improve sleep, mood and posture, promote good muscle tone, strength and endurance, and even help prevent or treat gestational diabetes, and help prepare women for labor and childbirth.

I have invented a new and novel exercise garment that fills a gaping void in the maternity and exercise clothing market. My invention provides a support panel that in one embodiment is included in an exercise pant garment that is comfortable, wicks away perspiration, is supportive and that can be used throughout pregnancy (or other distension of the belly) as changes occur, throughout the typical 40 week gestation period. Further, the garment can be used immediately after pregnancy to aid in exercise and by persons who have large belly regions for other reasons besides pregnancy. In other embodiments, as will be explained below, the panel and support mechanism can be included in a body suit, jumper and other types of clothing that can be made with the structure defined herein as well as a independent component for attachment to existing clothing.

SUMMARY OF THE INVENTION

In accordance with the present invention, an exercise garment is provided having specific supportive panels for providing adequate back and belly support. The supportive panels are made of composites of expandable materials giving structural support to the garment such that the wearer's back is stabilized and the belly is supported to prevent drastic pitch, roll and yaw movements during exercise. The expandable materials are designed to give such that excessive pressure against the belly is not caused as such pressure, found in garments of the prior art, can inflict pain to the musculature and skin surface of the wearer. The expandable materials provide support and allow for the natural growth of the body during pregnancy, providing a desirable combination of a supportive exercise garment that can be used throughout the gestation period.

In particular the current invention is a support garment having a first panel of cloth sufficient to cover a human belly and a second panel of cloth sufficient to cover the rear of a human, the first and second panels working together through concomitant connective means to form a wearable garment. The first and second panels further each comprising flexible structures to support the wearer at about the belly and rear of the wearer such that the wearer can move about in comfort and without generally free movements of the belly. In addition the first panel of the garment is made of a wick-able and stretchable cloth and the second panel is made of a stretchable cloth. The first and second panels include elastic material to help support the belly and buttocks of the user. In the preferred embodiment, the first and second panels comprise stretchable cloth panels within a garment having leg segments and an elastic waist band, such that when the garment is placed on a human body the front panel encases the belly, with the waist band above the belly at the front and with the waist band at the rear of the human being generally level with the front of the waist band.

The support garment of the present invention is designed such that when the garment is placed on the human body, the waist band remains generally unmoved, relative to the waist line of the wearer, during activity. In one embodiment the garment includes an upper leg portion and a lower leg portion on each leg of the garment and fastening means between the upper and lower leg portions such that the lower leg portions can be separated from the garment to form fashionably distinct forms of the garment.

In a further embodiment the garment includes additional elastic material to provide supportive compression to the thighs when worn, further the garment includes a waist band having elasticized material to prevent the waist from slipping below the belly in the front of the garment during use when first placed on the body.

In one embodiment the garment is an exercise garment for providing additional support at the belly of a pregnant woman. The garment has a front and a rear section joined together to form a wearable garment, the front section having a lower portion and an upper portion relative to the standing human form and the rear section having a lower portion and an upper portion relative to the standing human form. The front and rear sections each are made of cloth having a surface area sufficient to at least surround and cover the thighs, buttocks and crotch of an individual at the lower portions and the front portion having a surface area sufficient to surround the torso to at least the top of the belly at its upper portion. The front section further having a flexibly-elastic structural panel incorporated thereon, for support of the wearer at about the belly and back of the wearer such that the wearer can act without causing generally free movements of the belly.

DETAILED DESCRIPTION OF THE ILLUSTRATIVE EMBODIMENT

Figure 1:
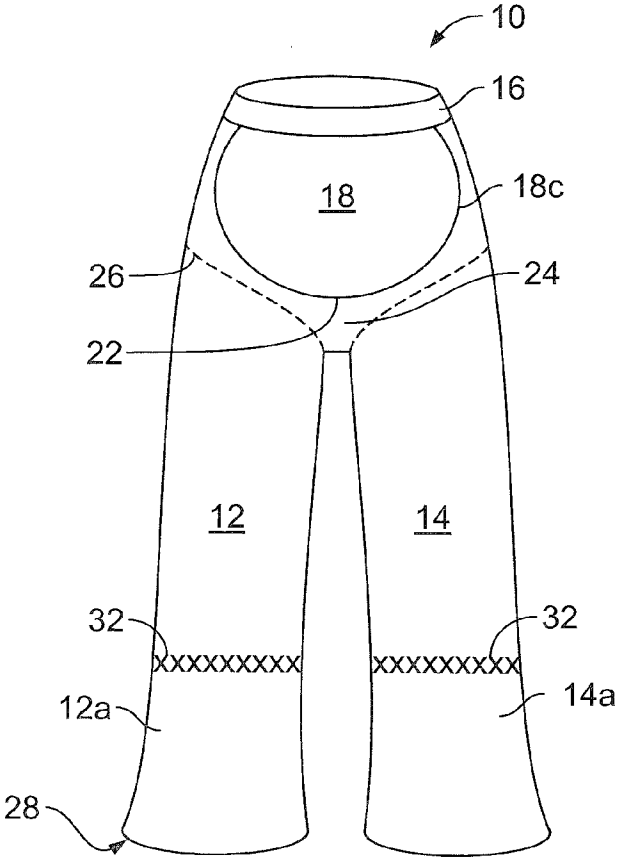
FIG. 1 is an elevational view of the front of a garment made in accordance with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

Referring now to the drawings, it will be seen that the present invention is depicted as a pair of pants of a conventional design. It will be understood that the invention can be applied to any manner of garment that comprises in full or part an element that covers the upper legs and belly and that the drawings are merely presented to give an idea of at least one garment to which the invention can be applied.

Figure 2:
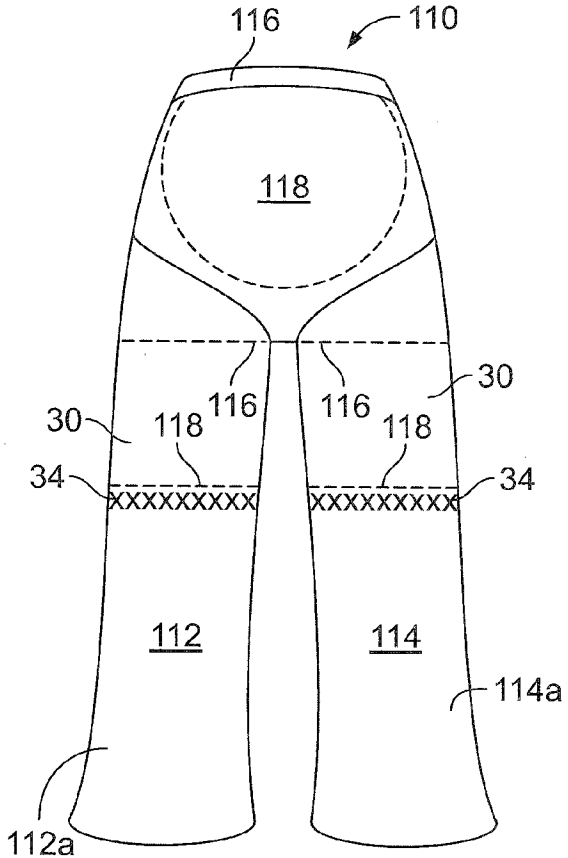
FIG. 2 is an elevation view of the rear of the garment of FIG. 1.

FIG. 1 shows a front view of the garment 10 of the present invention. As can be seen garment 10 comprises a pair of pants having a first leg 12 and second leg 14 and a waist 16 which are typical of any conventional pair of pants. In addition, as shown in FIG. 1, the garment includes a belly support system 18 of the present invention. In FIG. 1, the belly support panel 18 has been included on the outside of the pant 10; both for design considerations and functionality. As shown in FIG. 2 a similar pair of pants 110 is shown having a similar construction as the pants in FIG. 1 except that the belly support system 118 of the present invention has been included on the inside of the pant 110.

In a preferred embodiment, the belly support system 18, 118, as shown in FIGS. 1 and 2 will be constructed of a stretchy, breathable fabric, such as Supplex Lycra®, Spandura®, Dorlastn® or other Spandex® material including such materials combined with natural fabrics including, but not limited to cotton and bamboo fabrics. The belly support system not only includes the use of such fabrics, but a combination of panels configured, made with different materials, and located to provide comfortable support to the belly, legs, thighs, buttock and waist of the user as will be discussed in greater detail below. The use of any fabrics or combinations, including natural and man-made fabrics that provide the structural and comfort characteristics described herein can be used in the present invention without departing from the novel scope of the invention.

Figure 3:
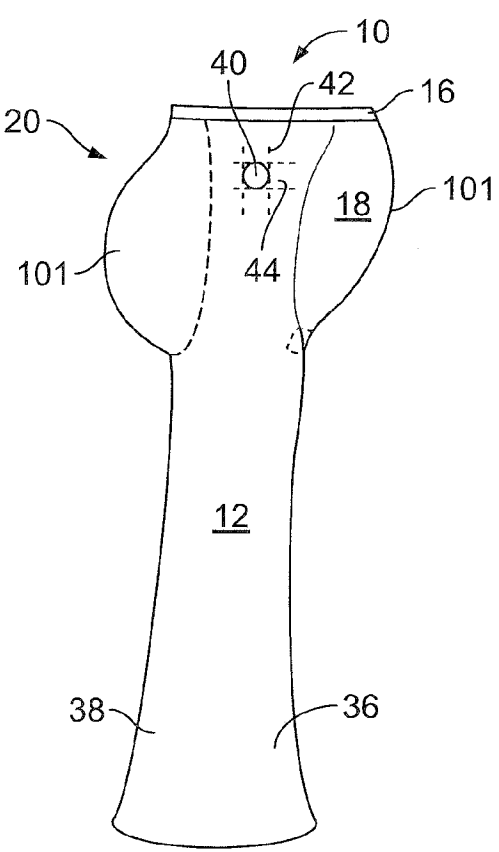
FIG. 3 is a side elevational view of a garment made in accordance with the teaching of the present invention.

As will be understood by persons having ordinary skill in the art, the belly support system 18 of the present invention will, when included in a garment 10, such as those shown in the attached figures, have the capability of being pulled up onto and over the belly of the wearer with a stretchable fabric, as described in detail below, throughout pregnancy and independent of the size of the belly. In addition, as the pant 10, generally shown as standard yoga pants, is pulled over the belly in the front, the rear portion 20 of the pant, as shown in FIG. 3, will, by providing stretchable support (in a manner to be described in detail below), allows the waist band 16 to remain generally at the same level in the front 10*f* and rear 10*r*; even as the belly continues to grow.

As shown in FIG. 1, the shape of the belly support system 18 will, in a preferred embodiment, be generally a half circle shape, depicted by line 18*c*, extending from waist band 16 at the front and curving down to the bottom of the belly 22, with the semi-circle encompassing the entire belly portion and extending, at the sides to the edge of the outer thighs at the front of the garment. It will be understood that support system 118, even though within the pant, in a preferred embodiment has a similar shape. As will be shown below, and in additional figures, various means of placement and the locations of various elements of the support panel and the use of materials better suited to specific areas of the support system, and that comprise the support panel and panels of the present invention are shown and variations can be made without departing from the novel scope of the present invention.

Continuing with the description of garment 10, the inseam for the crotch panel 24 is shown and comprises, in a preferred embodiment, a wick-able, breathable fabric. Such fabrics, and others described herein, are well known to persons having skill in the art; a number of these fabrics have been mentioned herein with their registered trademark names, however other fabrics can be used, including those that are neither wick-able nor breathable without departing from the novel scope of the present invention.

Referring again to FIG. 1, in one embodiment of the present invention the legs 12, 14 of the pants can be constructed of cotton from at least the bottom of the belly 22 to the bottom of the legs 28. In another embodiment cotton fabric is used from below the crotch line 26 to the bottom of the leg of the pants. As is well known in the garment industry and by persons having ordinary skill in the art, cotton is a very popular fabric combining strength, durability and ease of maintenance with the ability to breathe and thereby provide comfort to the user. It will be understood that other fabrics can be used without departing from the novel scope of the present invention.

In other embodiments of the garment 10, 110 of the present invention, as shown in FIG. 2, the pants 110 can be created with structure and materials that can provide additional thigh support, such as shown at 30. Such structure, which can be added to area delineated between lines 116 and 118 on garment 110, could be the type used in support hosiery and can be included within the garment to give further support to the user. In particular, the material in the thigh sections 30 could, in the preferred embodiment, comprise a greater ratio of elastic to cotton, than in the remainder of the garment, to provide compression and improve circulation.

In addition to the support given by the garments 10, 110 of the present invention, it has been determined that users of such garments will fail to utilize such garments if some sense of fashion is not created. Therefore, the present invention allows, in some embodiments, the reconfiguration of the garment so as to allow for the users desired configuration. As shown in FIG. 1, the pant legs 12, 14 can be created of multiple sections having removal parts 12*a* and 14*a*, respectively that allow for a bell bottom design pant to be converted into Capri style pants. As can be seen in FIG. 1, a fastening means 32 is provided around the circumference of the pant leg for removal, and subsequent replacement, of this portion 12*a* at about the mid-calf of the pant leg 12 and thereby change the pants into Capri style pants. It will be understood that any method of fastening means, including but not limited to a zipper, snaps, buttons or hook and loop fasteners such as Velcro® can be used to fasten lower leg portion 12*a*, 14*a* to the garment without departing from the novel scope of the present invention. In addition, the fasteners can be used as part of the decorative design of the garment or can be used to show a mechanical or utilitarian aspect of the design. It is further envisioned, that a garment 10 can be purchased with fastening means 32 in place but without lower leg portion 12*a*, 14*a* and that the user can then separately purchase whatever design of lower pant leg desired. In this way, one user can have a large flair bell bottom pant or a straight leg bottom pant or a boot cut pant or can add no element and have a Capri pant. The garment could further be embellished by having lower leg portion 12*a* and 14*b* comprise different materials and/or colors to allow a wide range of designs and flourishing of the garment 10.

Similarly, as shown in FIG. 2, the pant 110 can include fasteners allowing for the removal and then replacement of the lower pant portion 112*a* and 114*a*, beginning right above the knee to change the pants into shorts. As indicated above any type of fastener, but preferably a zipper or a hook and loop fastener device such as Velcro® can be used around the circumference of the pant leg for removal of this portion. It will be understood by persons having ordinary skill in the art that buttons, tape, snaps and/or other means to fasten panels together as known by persons having ordinary skill in the art can be used to hold these panels together, without departing from the novel scope of the present invention.

Referring now to FIG. 3, a lateral view of a garment of the present invention is shown to better illustrate the shape of the garment when used during pregnancy. The pant 10 shows the full pant embodiment with the flare shape 36 at the foot holes of the pant to create a flattering yoga-pant like shape. The flare of the leg portion also permits the user to put these pants on and take them off with greater ease and comfort. In another aspect of the invention, the design and use of the pant can be licensed to various clothing manufacturers; who for example may include various indices of brand 38. It will be seen that the present embodiment includes the elastic waste band 16 and the belly support system 18 of the present invention. Further, it will be seen that waist band 16 maintains a generally horizontal configuration, about its entire circumference, when in use, to provide comfort and support. In the illustrative embodiment of the garment of the present invention licensee the Bump Buddy™ Pant has included its stylized BB™ trademark on the garment. In this manner the trademarks of licensees can be incorporated within and on the garment thereby providing added incentive for purchase by persons interested or loyal to particular brands.

In a further embodiment of the garment of the present invention, fasteners 40 are included at about the hips on the side of the pant 10 so that the pant can be expanded laterally with panel 42 or for more horizontal comfort using panel 44. It will be understood that one or more panel can be included with one or more fastening means concomitantly applied thereto to release panels as shown, Fasteners such as, but not limited to, Velcro® or other hook and loop fasteners, snaps or buttons can be interchangeably used as needed or desired without departing from the novel scope of the present invention. Other methods of providing expansion, including darts, buttons, extra panels that can be attached as needed or other methods including sewing techniques known to persons having skill in the art can be used without departing from the novel scope of the present invention.

Figure 5:
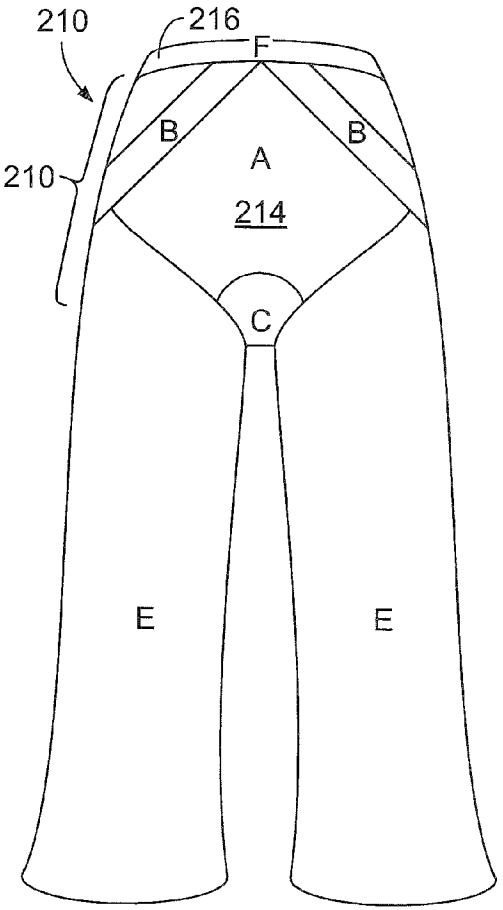
FIG. 5 is a view of a further embodiment of a garment made in accordance with the teachings of the present invention.
Figure 4:
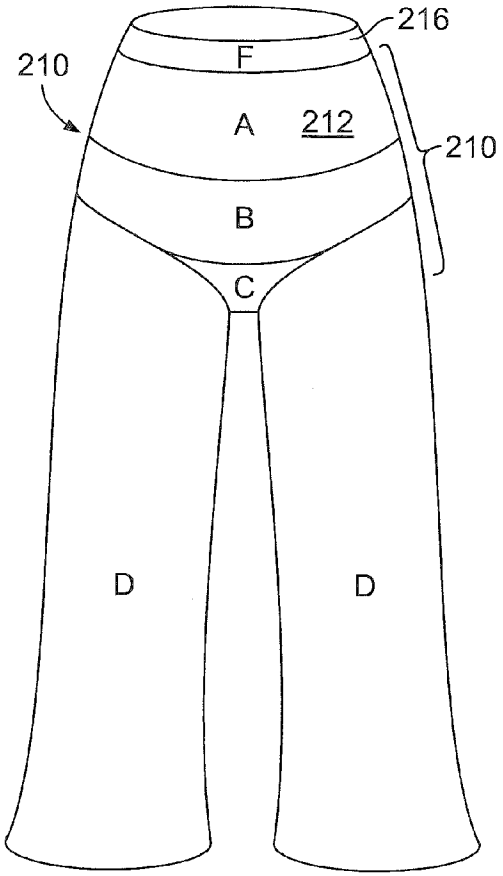
FIG. 4 is a view of a further embodiment of a garment made in accordance with the teachings of the present invention.

Referring now to FIGS. 4 and 5, a second preferred embodiment of the present invention is shown. FIG. 4 shows the front 212 of a garment 210; FIG. 5 shows the rear 214 of garment 210. The garment is of a similar design as those shown in the preceding drawings and functions in a similar manner; however, as shown and described panel 18 shown in FIG. 1 is in the present embodiment divided into at least 3 sections, labeled A, B and C in the present embodiment, to permit better control both of the body and its ability to remain comfortable during use. In one preferred embodiment, the lettered zones, shown in the drawings, represent the following fabrics and structural use of fabric:

A—Double layer of natural fabric provides moderate support to the buttock and mid-belly. In the preferred embodiment, bamboo fabric is used, however, persons having ordinary skill in the art will recognize that any breathable, stretchable fabric that allows for perspiration and belly expansion may be substituted without departing from the novel scope of the present invention. The control panel area may be extended to provide greater compression for the thighs.

B—Belly control band covers the lower third of the belly to the hip seam, and wraps around to converge at mid-back, providing support in both the front and back. In the preferred embodiment the control band is sewn into the interior of the pant, between the two layers of the control panel but is shown in solid lines here for illustrative purposes. Further, the use of Spandura® or additionally any strong, yet soft stretchable fabric with superior elasticity may be substituted by persons having ordinary skill in the art without departing from the novel scope of the present invention.

C—Wickable crotch panel illustration calls for Bamboo fabric; any breathable natural fabric may be substituted.

With respect to the remainder of the garment, the materials use can include the following:

D/E—Single layer of natural fabric allows for comfort and movement in the pant legs Illustration calls for Bamboo fabric; any breathable, stretchable natural fabric may be substituted. It will also be understood that heavier fabrics, such as wool and polyesters can be used to provide a garment that is supportive and also conserves body heat for use as everyday wear during winter months, can be substituted for additional useable garments without departing from the novel scope of the present invention.

F—Elastic waistband holds the pant up above the belly while the belly control band and control panels support the entire belly. The illustration calls for a one inch elastic band; it will be seen that elastics in varying thicknesses may be substituted without departing from the novel scope of the present invention. In a preferred embodiment the elastic band is secured with an expandable cover stitch.

In the embodiment shown in FIGS. 4 and 5 the panel 210 and waist band 216 are broken up into the 4 segments shown to illustrate that the panel can be created using a multitude of areas of differing or cooperative materials to cause a synergetic effect in the creation of the panel 210.

Figure 6:
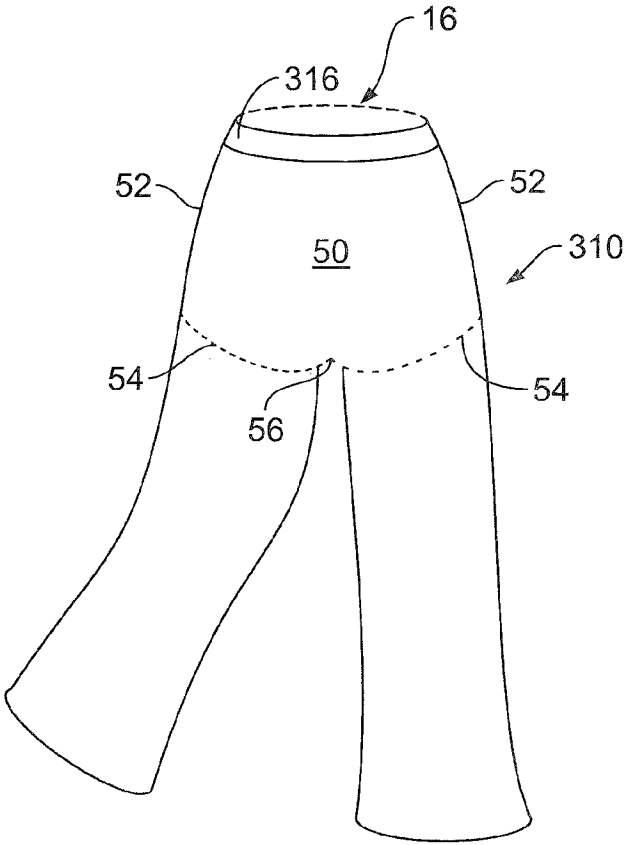
FIG. 6 is a rear view of a garment made in accordance with the present invention.

Referring now to FIG. 6, the rear view of another embodiment of the garment pant 310 of the present invention is shown without thigh support (as shown in FIG. 2 at 30). Instead, in the present embodiment, a compression system 50 is provided in the rear of the pants. The compression system, created as a panel similar to the panel 18 used in the front of the garment shown in FIG. 1, has a tendency to stretch from the elastic waistband 316, to the sides 52 of the pants, the bottom area 54 and even to the crotch 56. This compression system 50 would, in a preferred embodiment, be constructed of stretchy, breathable fabric, such as, but not limited to, Supplex Lycra®, Spandura®, Dorlastan® or other Spandex® material and cotton as known by persons having skill in the art. In a preferred embodiment this area of the pants 310 would use a fabric having ratios of more elastic material than cotton fabric than the belly support system for this embodiment (not shown) which is on the front of the pants, as discussed above. As a result, more resilience and therefore support would be generated here.

Although illustrative embodiments of the invention have been shown and described, it is to be understood that various modifications and substitutions may be made by those skilled in the art without departing from the novel spirit and scope of the invention.

What is claimed:

1. A garment, to be worn by a user who has a protruding belly, the garment comprising:

a front panel and a rear panel attached together to form a wearable item of clothing;

the garment having a waist band made of stretchable material;

the front and rear panel comprising a first section of cloth depending directly adjacent the waist band and extending in a band from about the lateral center of the belly in the front of the garment and extending to cover substantially the buttocks in the rear of the garment;

a second section of cloth depending in a more narrow band than the first section of cloth from adjacent to the first band of cloth in the front of the garment to the part of the garment that covers the hips of the user, on both the right and left sides of the garment, and angling from there to the waistband of the garment, crossing and reinforcing the rear portion of the first section of cloth;

a third section of cloth depending from adjacent the second section of cloth in the front of the garment to adjacent the first section of cloth in the rear of the garment to substantially cover the crotch and the inter-leg portion of a user when the garment is worn.

2. The garment of claim 1, wherein the first section of cloth is made of a natural fabric selected from the group consisting of a stretchy bamboo and cotton blend fabric to provide moderate support to the buttocks and belly; the second section of cloth is made of a fabric selected from the group consisting of spandex, or other elastic fabric, reinforced with filaments made substantially of nylon; the third section of cloth is made of a wick-able cloth selected from the group consisting of bamboo fabric and cotton.

3. The garment of claim 1, wherein the garment includes pant legs, the pant legs comprising an upper leg portion and a lower leg portion on each pant leg of the garment and fastening means between the upper and lower leg portions such that the lower leg portions are separable from the garment.

* * * * *